US007753749B2

(12) United States Patent
Mun et al.

(10) Patent No.: US 7,753,749 B2
(45) Date of Patent: Jul. 13, 2010

(54) SWIM FIN

(75) Inventors: John Mun, Irvine, CA (US); Craig Stiff, Redondo Beach, CA (US)

(73) Assignee: Warnaco Swimwear, Inc., Los Angeles, CA (US)

( * ) Notice: Subject to any disclaimer, the term of this patent is extended or adjusted under 35 U.S.C. 154(b) by 207 days.

(21) Appl. No.: 12/164,211

(22) Filed: Jun. 30, 2008

(65) Prior Publication Data

US 2009/0325434 A1 Dec. 31, 2009

(51) Int. Cl.
*A63B 31/08* (2006.01)

(52) U.S. Cl. ..... 441/64

(58) Field of Classification Search ..... 441/55, 441/56, 64

See application file for complete search history.

(56) References Cited

U.S. PATENT DOCUMENTS

| | | | | |
|---|---|---|---|---|
| 915,457 | A | 3/1909 | Marroffe | |
| 1,786,451 | A | 12/1930 | Louis | |
| 1,841,904 | A | 1/1932 | McGowan | |
| 2,099,973 | A | 11/1937 | De Corlieu | |
| D124,013 | S | 12/1940 | Churchill | |
| 2,588,363 | A | 3/1952 | De Corlieu | |
| 2,672,629 | A | 3/1954 | La Trell | |
| 2,889,563 | A | 6/1959 | Lamb et al. | |
| 3,055,025 | A | 9/1962 | Ferraro et al. | |
| 3,183,529 | A | 5/1965 | Beuchat | |
| 3,422,470 | A | 1/1969 | Lodovico | |
| 3,649,979 | A | 3/1972 | Macniel | |
| 3,913,158 | A | 10/1975 | Vilarrubis | |
| 4,083,071 | A | 4/1978 | Forjot | |
| 4,627,820 | A | 12/1986 | Penebre | |
| 4,775,343 | A | 10/1988 | Lamont et al. | |
| 4,913,418 | A * | 4/1990 | Schlueter et al. | 482/55 |
| 4,923,419 | A | 5/1990 | McCarthy | |
| 4,948,385 | A | 8/1990 | Hall | |
| 5,100,328 | A | 3/1992 | Badgley | |
| 5,292,272 | A | 3/1994 | Grim | |
| D349,552 | S | 8/1994 | Fleming | |
| 5,387,145 | A | 2/1995 | Wagner | |
| 5,417,599 | A | 5/1995 | Evans | |
| 5,588,890 | A | 12/1996 | Garofalo | |
| D379,398 | S | 5/1997 | Garraffa | |

(Continued)

FOREIGN PATENT DOCUMENTS

| | | |
|---|---|---|
| GB | 746764 | 3/1956 |

(Continued)

OTHER PUBLICATIONS

Vapor Swim Fin, Image taken Jun. 7, 2007.

(Continued)

*Primary Examiner*—Stephen Avila
(74) *Attorney, Agent, or Firm*—Katten Muchin Rosenman LLP

(57) ABSTRACT

A swim fin includes a foot pocket and a blade portion. The blade portion includes a top surface and a bottom surface. An opening is disposed through the blade portion to permit an enhanced directional fluid flow between the top and the bottom surface. A top bevel is disposed in the top surface and surrounds the opening. The top bevel includes a trailing and a leading top bevel area to compress the fluid flow.

18 Claims, 10 Drawing Sheets

U.S. PATENT DOCUMENTS

| | | | | |
|---|---|---|---|---|
| 5,702,277 | A | 12/1997 | Wagner | |
| 5,709,575 | A | 1/1998 | Betrock | |
| 5,746,631 | A | 5/1998 | McCarthy | |
| 5,975,973 | A | 11/1999 | Fleming | |
| 6,053,788 | A * | 4/2000 | Garofalo | 441/64 |
| 6,146,224 | A | 11/2000 | McCarthy | |
| 6,152,794 | A | 11/2000 | Liu | |
| 6,179,675 | B1 | 1/2001 | Godoy | |
| 6,224,443 | B1 | 5/2001 | Mehrmann et al. | |
| 6,290,560 | B1 | 9/2001 | Kidd et al. | |
| D450,365 | S | 11/2001 | Evans | |
| 6,371,821 | B1 | 4/2002 | McCarthy | |
| 6,379,203 | B1 | 4/2002 | Kuo | |
| 6,394,863 | B1 | 5/2002 | Chen | |
| 6,435,926 | B1 | 8/2002 | Yeh | |
| D463,840 | S | 10/2002 | Reeder | |
| 6,482,059 | B2 | 11/2002 | McCarthy | |
| 6,497,597 | B2 | 12/2002 | McCarthy | |
| 6,568,973 | B2 | 5/2003 | Testa | |
| 6,568,974 | B2 | 5/2003 | Semeia | |
| 6,585,548 | B2 | 7/2003 | McCarthy | |
| 6,607,411 | B1 | 8/2003 | McCarthy | |
| 6,620,009 | B1 | 9/2003 | Jermyn | |
| 6,663,452 | B1 | 12/2003 | Myers | |
| 6,712,656 | B2 | 3/2004 | McCarthy | |
| 6,719,599 | B2 | 4/2004 | McCarthy | |
| 6,843,693 | B2 | 1/2005 | McCarthy | |
| 6,884,134 | B2 | 4/2005 | McCarthy | |
| 6,918,805 | B2 | 7/2005 | McCarthy | |
| 7,018,256 | B2 | 3/2006 | McCarthy | |
| 7,077,715 | B2 | 7/2006 | Vassallo | |
| 7,101,240 | B2 | 9/2006 | McCarthy | |
| 7,115,011 | B2 | 10/2006 | Chen | |
| D534,983 | S | 1/2007 | Testa | |
| 7,172,480 | B2 | 2/2007 | Abbott | |
| D553,218 | S | 10/2007 | Keegan | |
| 2004/0053547 | A1 | 3/2004 | Godoy | |
| 2005/0003719 | A1 | 1/2005 | McCarthy | |
| 2005/0176318 | A1 | 8/2005 | McCarthy | |
| 2005/0181689 | A1 | 8/2005 | McCarthy | |
| 2005/0186866 | A1 | 8/2005 | McCarthy | |
| 2006/0249630 | A1 | 11/2006 | McCarthy | |
| 2006/0264499 | A1 | 11/2006 | Wright et al. | |
| 2007/0032147 | A1 | 2/2007 | McCarthy | |
| 2007/0037459 | A1 | 2/2007 | McCarthy | |
| 2007/0077831 | A1 | 4/2007 | Kuo | |

FOREIGN PATENT DOCUMENTS

| | | |
|---|---|---|
| GB | 1223664 | 3/1971 |

OTHER PUBLICATIONS

Torpedo Swim Fin, Downloaded May 16, 2007.
Speedo Glide Fin, Downloaded Jun. 6, 2008.

* cited by examiner

SWIM FIN

FIELD OF THE INVENTION

The present invention relates to one or a pair of fins used in water related activities, especially, but not exclusively, in training by race swimmers.

BACKGROUND OF THE INVENTION

Swim fins, also called flippers or swimming fins, are used in water related activities to increase the surface area of the user's foot. With the larger surface area, the user is able to displace more water and propel themselves much faster relative to the water medium than with a bare foot.

Thus, fins are constructed with a substantial increase in surface area. The increase is made primarily in the blade portion, e.g., roughly the area forward of the user's toes and to a lesser extent the sides of the user's foot to gain maximum advantage from the portion of the leg muscles that are strongest during the propulsion component of a swim kick, the up beat.

Increasing the surface area provides significant benefits for some users. However, a large blade provides distinct disadvantages for other users, especially users who want or need a fast cycle of kicking since on the non-propulsion component of a swim kick, e.g., the down beat, the enlarged blade portion creates drag that must be overcome.

For example, a dive fin has relatively large surface area in comparison to other fin types to overcome the additional weight that scuba divers carry. Accordingly, divers typically swim at languid pace. The same fin is unsuitable for race swimmers, who swim at a fast rate. The drag induced by the large blade portion would hinder the swimmer on the down beat.

Such race swimmers condition their arms and shoulders in addition to their legs. When training, swimmers seek to achieve a high cycle rate of shoulder and arm movement alongside a leg movement. However, when training for a prolonged period of time, the legs often tire before the arms and shoulders, because the legs unlike the arms are constantly in water and must fight against water resistance. Thus, race swimmers turn to swim fins to maintain a training pace.

Swim fins having large blade portions are not suitable to establish and maintain a training pace. Thus, various solutions have been suggested to provide a fin that is suitable for training. Typically, these solutions involve shortening the blade portion so that the user has less drag than with a large blade and can increases the frequency of kicks, e.g., beats. See for example, U.S. Pat. No. 5,108,328.

By increasing the frequency, the swimmer is able to condition parts of their body that could not be conditioned as the swimmers legs tire from the frequent kicks. Thus, a short-swim fin provides an opportunity for a race swimmer to condition their arms and shoulders while permitting the legs to kick at a sustained rate.

However, simply shortening the blade fails to address that a swimmer has different needs during the kick. When the swim kick is in the up beat, e.g., propulsion portion of the kick, the swimmer's need is to propel themselves fast as possible. In contrast, when the kick is the down beat, e.g., retracting leg motion, the swimmer's need is to reduce drag so that the swimmer can kick again, e.g., increase the frequency of the kicks.

Another solution is to maintain the enlarged blade portion and make the fin more flexible. However, this leads to a fin having a large size that is difficult to maneuver on land and difficult to use in race swimming circumstances including turns made against a wall in a pool.

Thus, what is desired is a swim fin suitable for swim training and which permits a greater kick frequency and ease of use.

SUMMARY OF THE INVENTION

These and other needs are addressed by the present invention.

In accordance with one or more embodiments of the present invention, a swim fin includes a foot pocket and a blade portion. The blade portion includes a top surface and a bottom surface. An opening is disposed through the blade portion to permit an enhanced directional fluid flow between the top and the bottom surface. A top bevel is disposed in the top surface and surrounds the opening. The top bevel includes a trailing and a leading top bevel area to compress the fluid flow.

The swim fin includes a trailing or a leading top bevel area, which is larger than the other of the trailing and the leading top bevel area, and a trailing and a leading bottom bevel areas are substantially equal in size to retard fluid flow through the opening.

In accordance with one or more embodiments of the present invention, a swim fin includes a foot bed and a cover having a substantially convex shape. The cover encloses a portion of the foot bed to form a foot pocket for a user's foot. The cover includes a blade portion having a plurality of openings, where at least one opening is associated with a bevel for providing an enhanced directional fluid flow.

Other embodiments are disclosed and such embodiments may be combined by one skilled in the art to form yet further embodiments.

DETAILED DESCRIPTION OF THE INVENTION

Figure 1A:
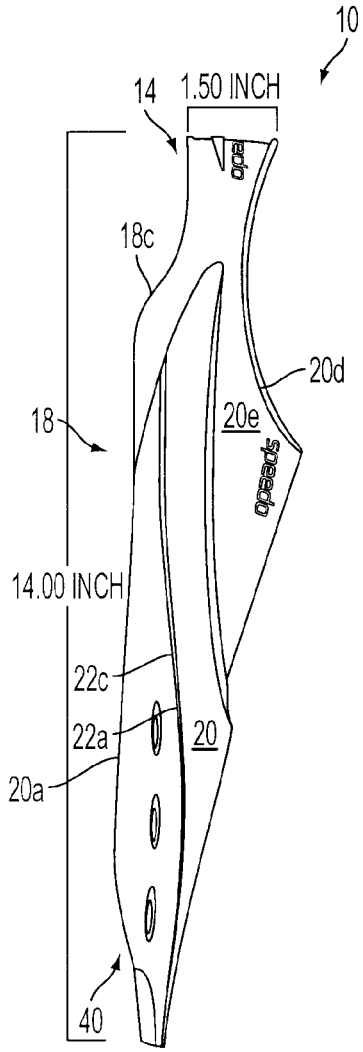
FIGS. 1*a*-1*d* are top, left, right, and bottom views, respectively, of a swim fin in accordance with one or more embodiments of the present invention.
Figure 1B:
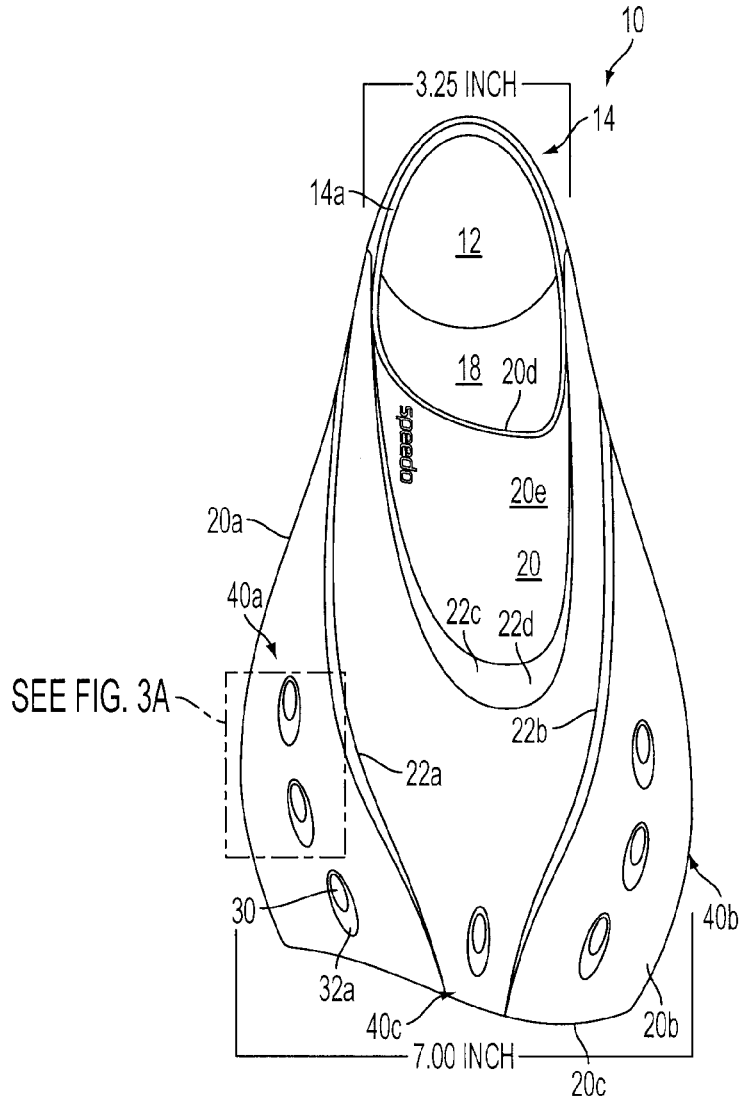
Figure 1C:
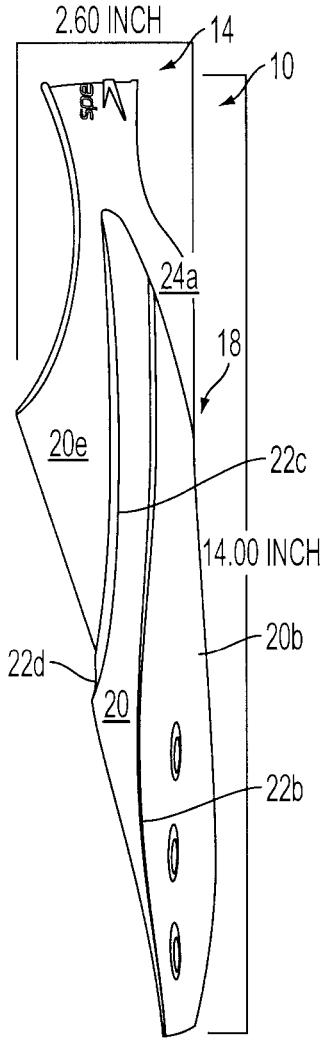
Figure 1D:
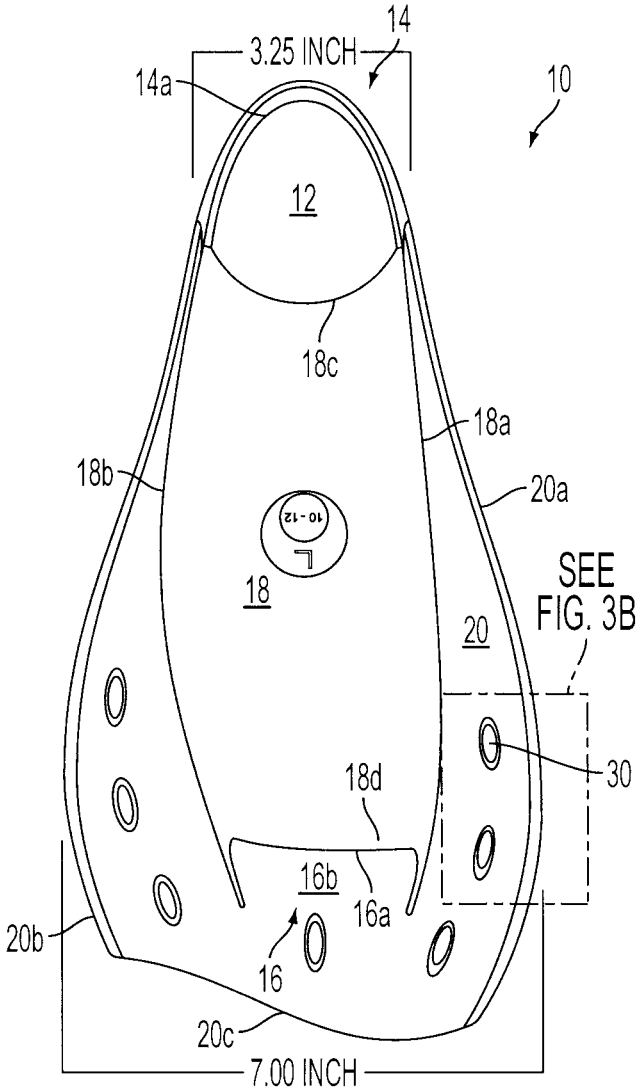
Figure 2:
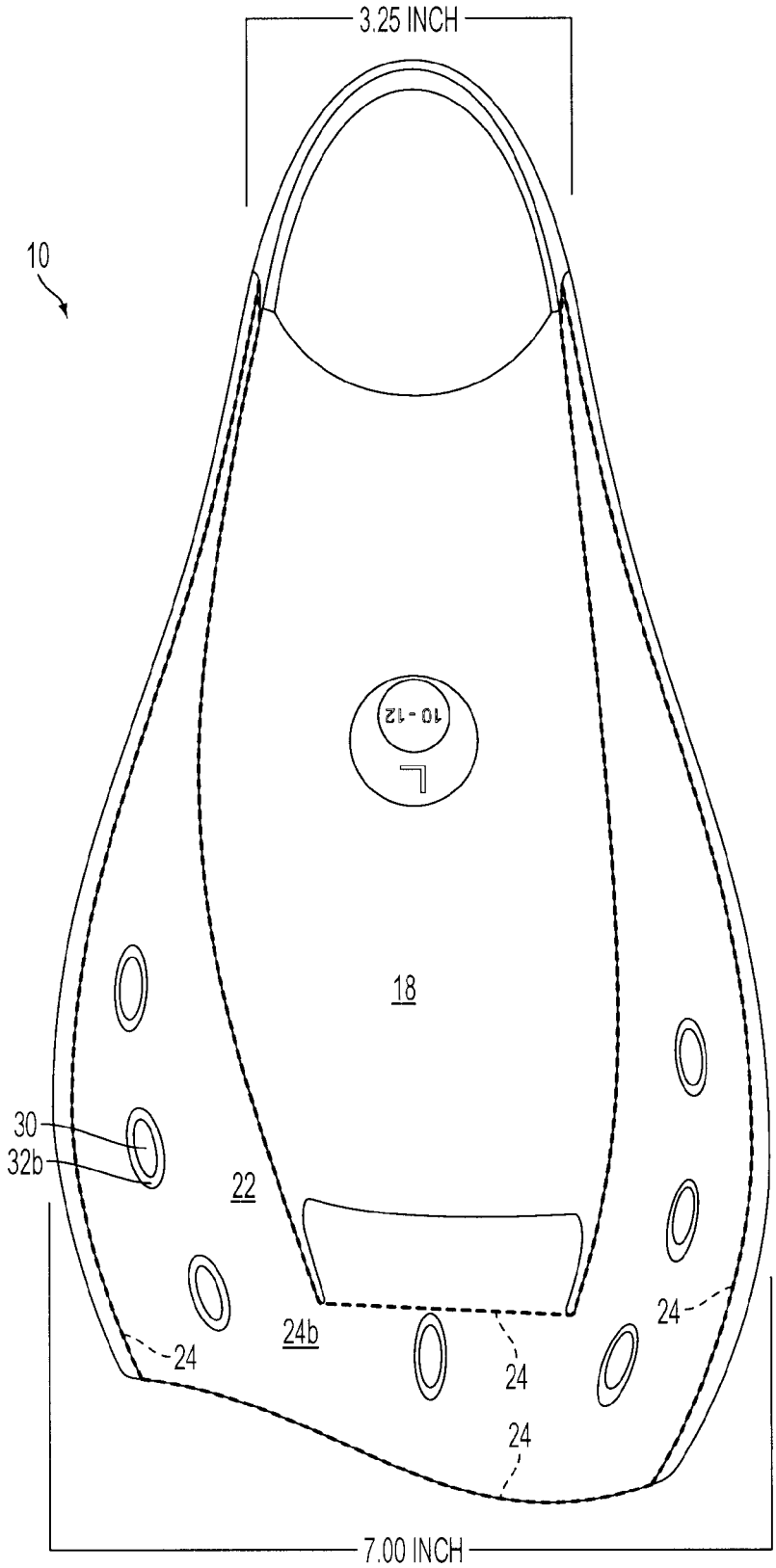
FIG. 2 is a bottom view of the fin of FIG. 1 and illustrating the blade portion.
Figure 3A:
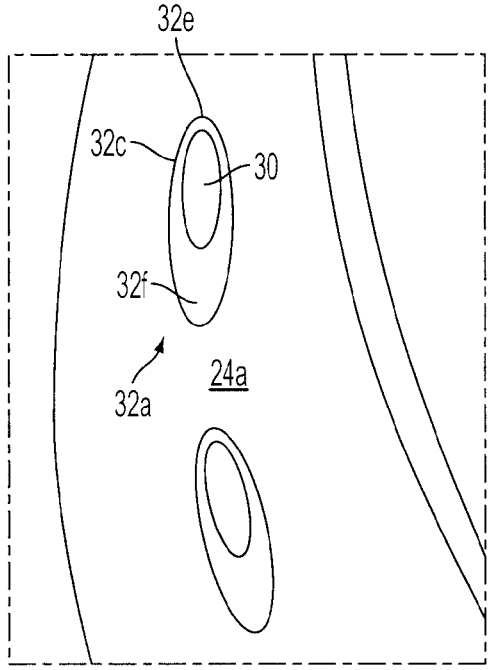
FIGS. 3*a* and 3*b* are detailed views of a portion of FIG. 1 and illustrating the openings and bevel.
Figure 3B:
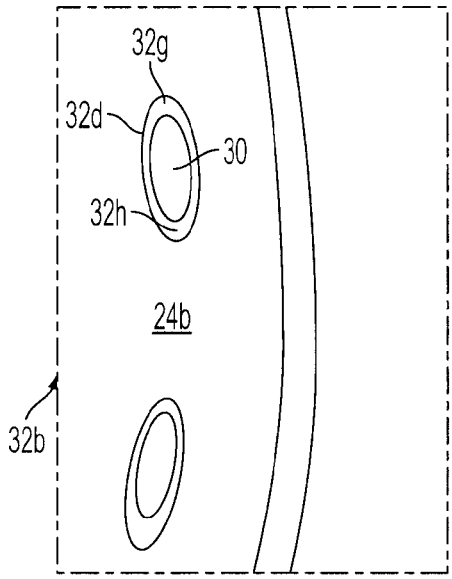
Figure 4A:
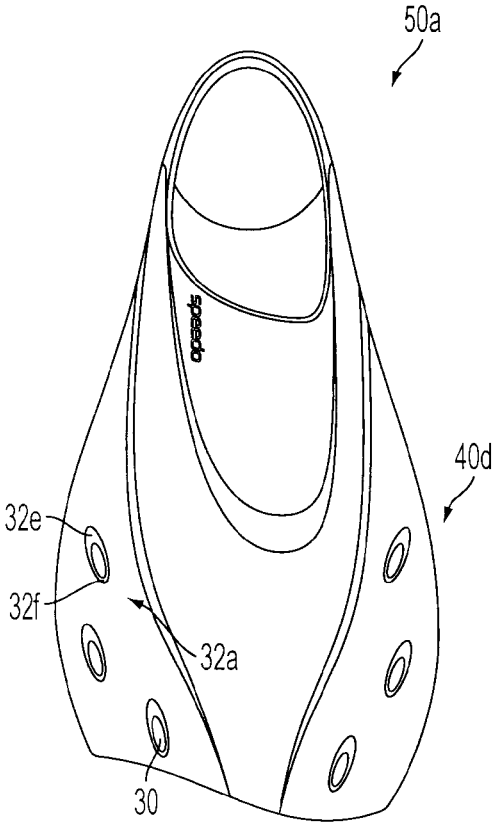
FIGS. 4*a*-4*f* are top views of swim fins in accordance with one or more embodiment of the present invention.
Figure 4B:
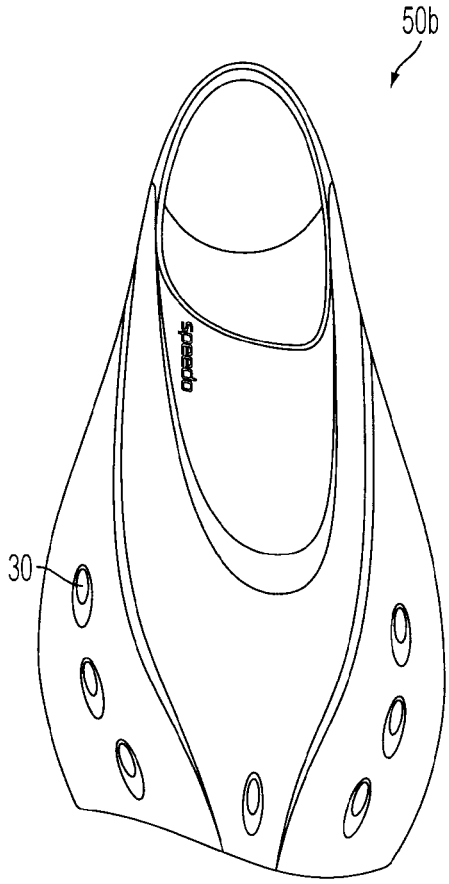
Figure 4C:
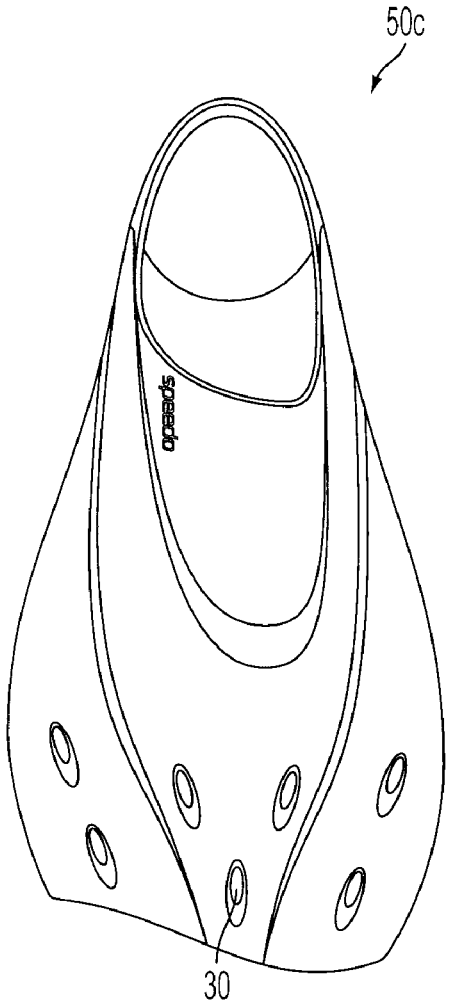
Figure 4D:
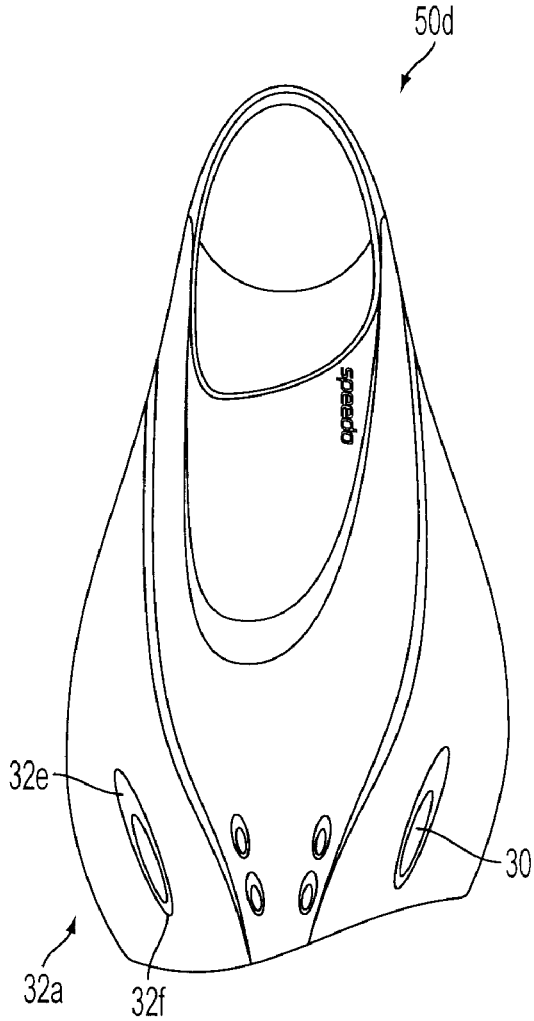
Figure 4E:
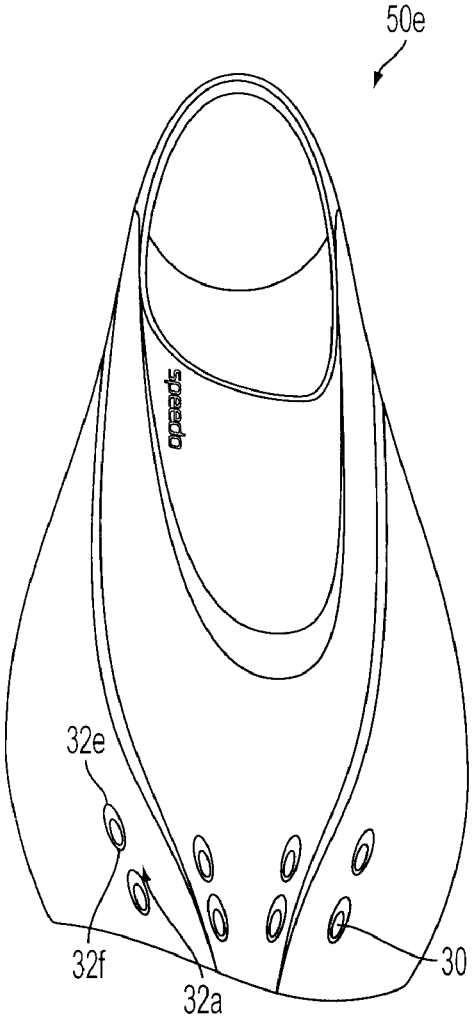
Figure 4F:
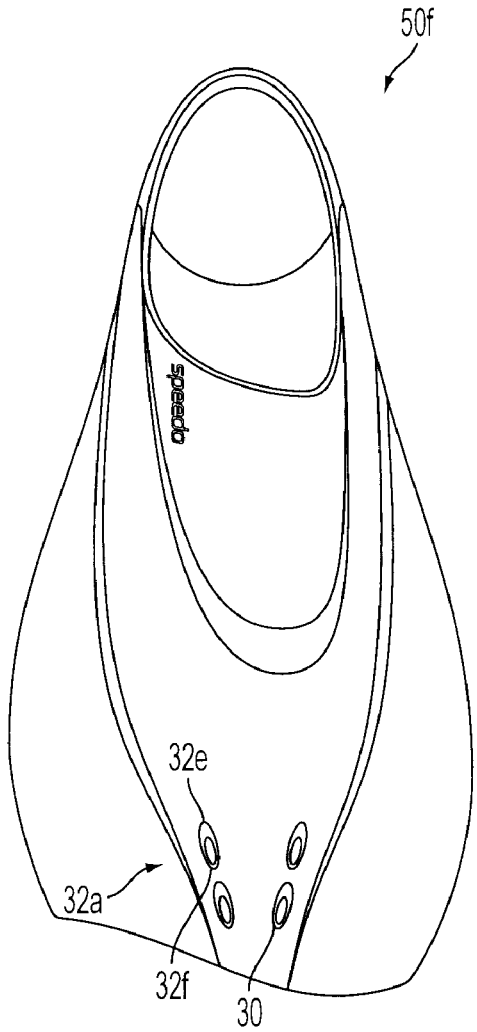
Figure 5A:
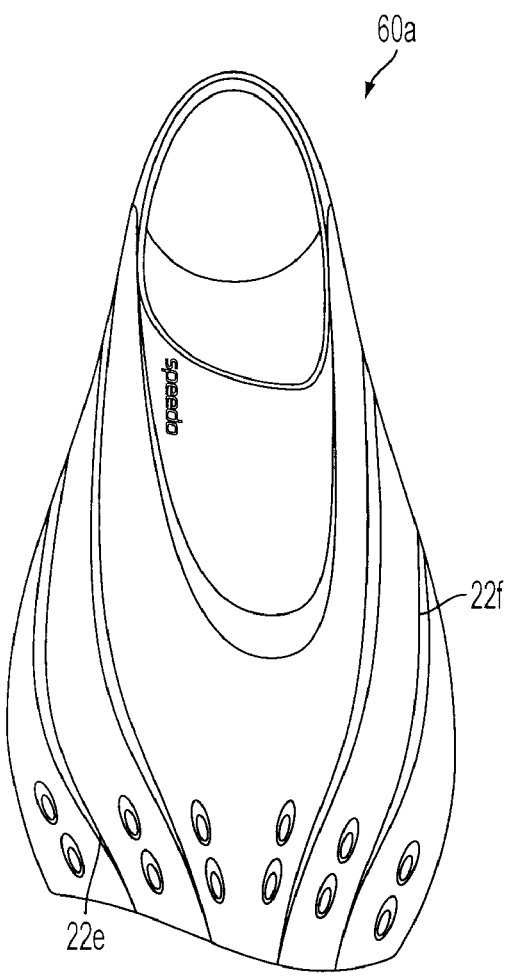
FIGS. 5*a*-5*f* are top views of swim fins in accordance with one or more embodiment of the present invention.
Figure 5B:
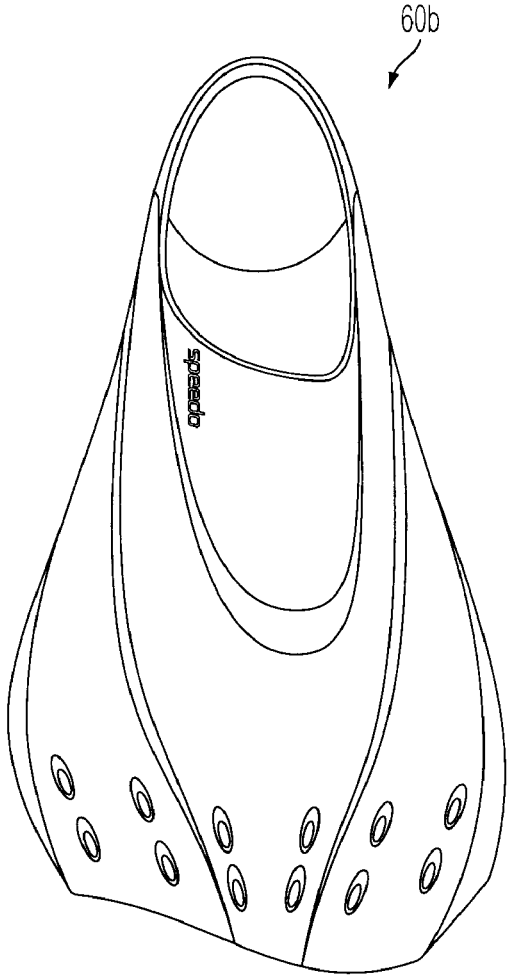
Figure 5C:
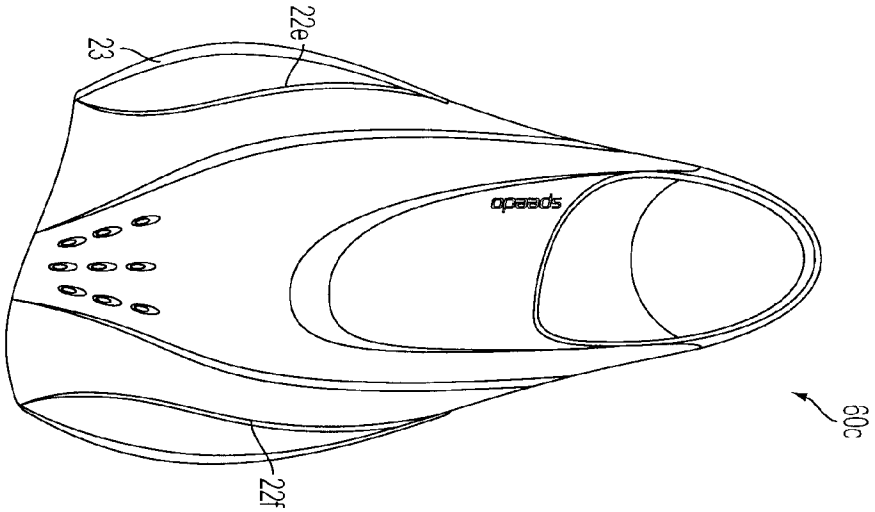
Figure 5D:
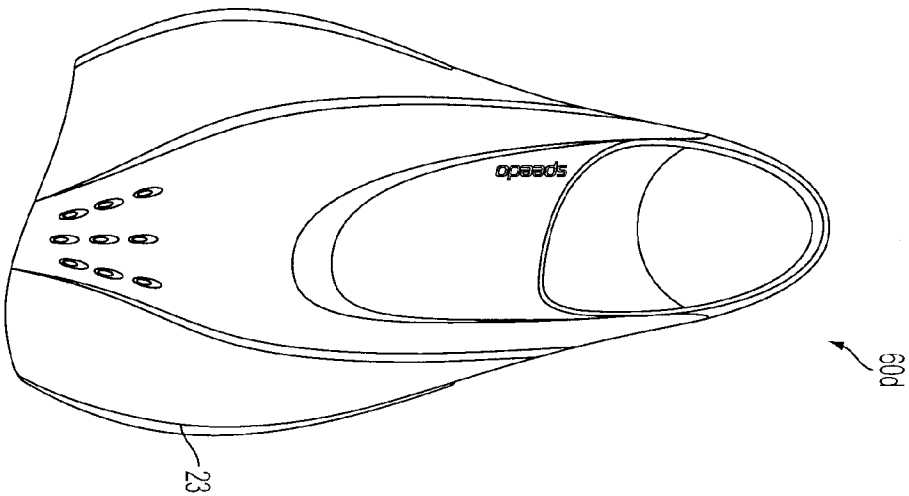
Figure 5E:
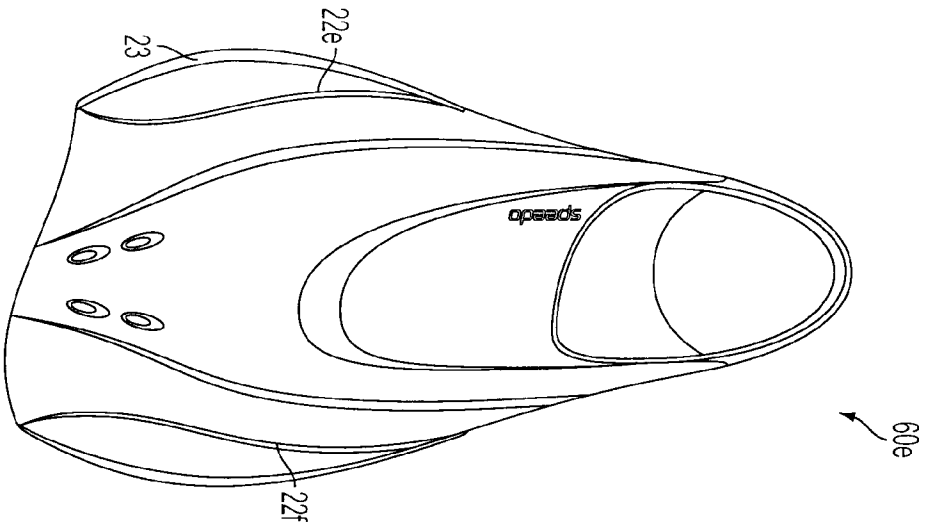
Figure 5F:
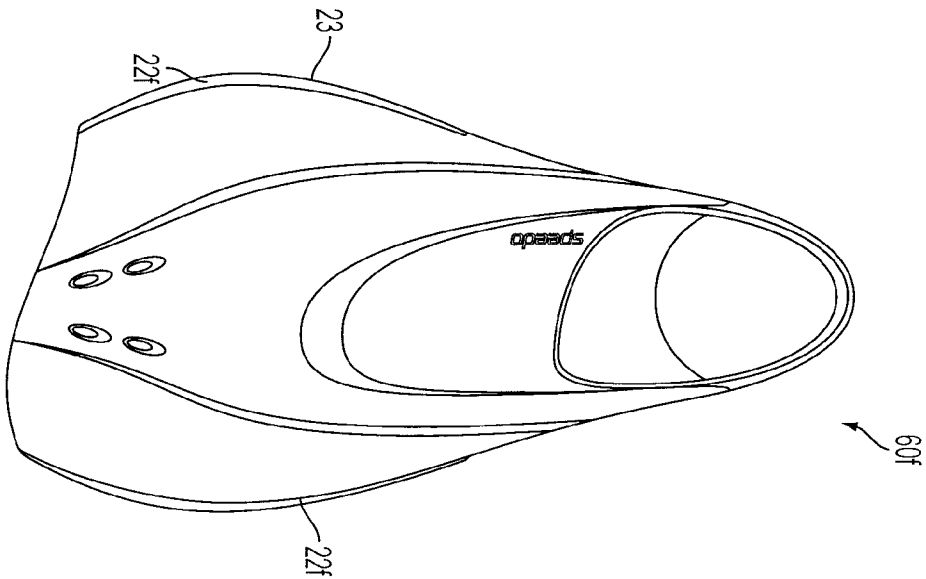

FIGS. 1*a*-1*d* are top, left, right, and bottom views, respectively, of a swim fin in accordance with one or more embodiments of the present invention. FIG. 2 is a bottom view of the fin of FIG. 1 and illustrating the blade portion. FIGS. 3*a* and 3*b* are detailed views of a portion of FIG. 1 and illustrating the openings and bevel.

The swim fin of the present invention is illustrated as a right-foot swim fin. As is understood by those skilled in the art, a left-foot fin is a mirror image of a right-foot fin. The present invention is intended to encompass a right-foot fin, a left-foot fin, as well as a pair of fins.

A swim fin 10 preferably comprises a short blade design suitable and is intended for use in fluid medium in a lake, sea, and/or pool, and may be used not only for swim training, but also for diving and/or other activities.

Fin 10 includes a foot pocket 12 that is defined in a longitudinal direction by a heel end 14 and a toe end 16 and in the lateral direction and height by a foot bed 18 and a cover 20. The foot pocket suitably receives the user's foot; and, thus, to accommodate different user's feet, fin 10 may be available in different sizes.

Fin 10 may be made of any suitable material, but for optimum performance is made of a material comprising a rubber and/or rubber-plastic material that provides suitable flexibility, yet maintains its shape. Preferably, fin 10 comprises a structure that is substantially semi-rigid, as discussed further below.

The heel end comprises a strap 14*a* and is configured as an open heel end. However, heel end 14 may also be enclosed as is generally known in the art. Similarly, toe end 16 comprises a reinforced edge structure 16*a* defining an opening 16*b*. However, toe end 16 may also be closed as is generally known in the art.

Foot bed 18 may be substantially U-shaped in cross-section to cradle the user's foot. The U-shape of the foot bed preferably comprises a flat surface such that a user is comfortable walking on the foot bed and side portions that may be rounded upward to meet a cover.

The intersection of the foot bed and cover define an inside, e.g., left, edge 18*a* and an outside, e.g., right, edge 18*b*, with respect to the user's foot. The foot bed further comprises a heel edge 18*c* and toe edge 18*d*.

Each edge of the foot bed may have any suitable shape, but, preferably, each edge in is ergonomic to the user's foot while providing a structurally durable and stable fin. Thus, heel edge 18*c* may be curved and toe edge 18*d* may be U-shaped.

Cover 20 encloses at least a portion of the foot pocket between the inside and outside edges 18*a*, 18*b*. The top portion further includes an inside edge 20*a*, an outside edge 20*b*, a front edge 20*c*, and a rear edge 20*d*, which together define the limits of a top surface 20*e*. Rear edge 20*d* and/or strap 14*a* preferably comprise a soft rubber beads for a comfort fitting.

The top portion also includes a blade portion 24 used for propulsion. The blade portion comprises a top surface 24*a* and a bottom surface 24*b*. The blade portion is defined as the region of the cover between foot bed inside edge 18*a* and top portion inside edge 20*a*, foot bed outside edge 18*b* and top portion outside edge 20*b*, and front edge 20*c* and which boundary is marked by broken lines in FIG. 2. Thus, front edge 20*c* is also the front edge of the blade portion and edges 20 and 2*b* are edges of the blade portion.

Cover 20 includes one or more channelization edges 22 in top surface 20*e*, e.g., top surface 24*a*. Preferably, edges 22 comprise a pair of edges 22*a*, 22*b* that approximately follow edges 18*a*, 18*b* and a generally U-shaped edge 22*c* proximate to an upper portion of a user's foot.

Edges 22*a* and 22*b* define a fluid flow channel therebetween, which aids in reducing drag around the user's foot. In fact, edges 22*a*, 22*b* may define fluid flow lines around the user's foot. U-shaped edge 22*c* preferably includes a shelf 22*d* that also aids in directing fluid flow and reduces drag.

To increase water displacement, cover 20 preferably comprises a generally convex shape (relative to the foot bed) in cross-section at the blade portion such that blade portion 24 is configured as a scoop for scooping water on the up beat of the swimmer's kick. Thus, the top surface may vary in shape throughout the fin and may have a more pronounced convex shape toward rear edge 20*d* and less at front edge 20*c*.

To enhance the scoop, edges 20*a* and 20*b* are preferably elongated to enlarge the effective volume of the scoop and increase the effectiveness of the blade portion. The convex shape of the cover provides a semi-rigid shape that helps the fin, e.g., the blade portion, maintain a semi-rigid shape.

Front edge 20*c* preferably comprises a compound curve that includes a radially inward curve proximate interior edge 20*a* and a radially exterior curve proximate to outside edge 20*b*. These curves align anatomically with the foot of a user, wherein the front edge is more distal from the rear of the fin at the big toe, e.g., hallux, than at the little toe. In this manner, the blade portion is provided with an anatomically advantageous size.

One or more openings 30 are disposed in the blade portion and aid the user in his or her activities by permitting a fluid flow through the opening in general and reducing drag, e.g., fluid resistance, on a portion of the swim kick, preferably the non-propulsion portion of the swim kick. Openings 30 may be arranged in a grouping 40 as discussed below.

Openings 30 preferably are associated with one or more bevels that permit a greater fluid flow from one side of the blade portion to the other side than vice versa, i.e., an enhanced directional fluid flow.

Therein, a top surface bevel 32*a* may be disposed in top surface 24*a* and a bottom surface bevel 32*b* may be disposed in bottom surface 24*b*. Each bevel is defined by a rim, which surrounds the opening, and, thus, the bevel provides a transition from the respective top or bottom surface to the opening. Bevel 32*a* is defined by a rim 32*c* at the level of the surrounding top surface, and bevel 32*b* is defined by a respective rim 32*d* at the level of the surrounding bottom surface.

In turn, top bevel 32*a* comprises a trailing bevel area 32*e* more distal from front edge 20*c* than a leading bevel area 32*f* and which is larger than the trailing bevel area. Preferably, each opening is configured as an oval shape and is disposed in top surface 24*a* off-center in the respective bevel 32*a* such that leading bevel area 32*f* is larger than trailing bevel area 32*e*.

In bottom surface 24*b*, bottom bevel 32*b* comprises a trailing bevel area 32*g* more distal from front edge 20*c* than a leading bevel area 32*h*. Leading bevel area 32*h* and trailing bevel area 32*g* may have an equal size.

Therein, top surface bevel 32*a* is larger than bottom surface bevel 32*b* and, thus, top surface bevel 24*a* reduces water resistance more than bottom surface bevel 32*b* resulting in compressed water flow through respective opening 30. The larger top surface bevel 32*b* promotes a faster down beat and results in faster as well as higher beats per cycle, while the smaller bottom surface bevel 32*b* retard fluid flow through the opening and promote greater propulsion on the propulsion portion of the swim kick, e.g., the up beat.

In accordance with one or more embodiments, fin 10 comprises one or more groupings 40 of at least one opening 30 disposed along a fluid flow line. Thus, fin 10 may comprise a grouping 40*a* and 40*b* of openings that are serially placed respectively between edges 22*a*, 22*b*, and edges 20*a*, 20*b* along a fluid flow line. One or more openings 30 may comprise a grouping 40*c* proximal to front edge 20*c*.

In accordance with one or more embodiments of the present invention, fin 10 comprises a length of 14.00 inches from a rear portion of strap 14*a* to a front-most portion of front edge 20*c*, a width of 7.00 inches from edge 20*a* to edge 20*b* at a widest most part, and a distance between the end portions of strap 14*a* of 3.25 inches. The ratio of the surface area of the blade portion to the surface area of the foot bed preferably comprises 1.1 or greater. The ratio of the length to width of the fin preferably is 2.0 or less.

FIGS. 4*a*-4*f* are top views of fins in accordance with one or more embodiments of the present invention. Therein, fins 50*a*-50*f* are substantially constructed as taught with respect to fin 10. However, each fin comprises a particular grouping of fins that are suitable for specific types of activities and for differing swimming abilities. Thus, a swimmer who is adept and who wishes to swim at a great speed may wish to train with a greater number of openings.

Fin 50*a* comprises a grouping 40*d* of openings 30 that are located proximal to edges 20*a* and 20*b*. The openings are preferably arranged in a staggered pattern. While fin 50*a* omits an opening in the central forward area, fin 50*b* includes such an opening and has similar groupings of openings 30 as fin 10. However, openings 30 in fin 50*b* are less oval.

Fins 50*c*-50*f* concentrate the openings in an area proximal to front edge 20*c*. Therein, the size and the number of openings are varied. Moreover, fins 50*a* and 50*d*-50*f* comprise a bevel 32*a* configured to have trailing bevel area 32*e* that is larger than the leading bevel area 32*f*.

FIGS. 5*a*-5*f* are top views of fins in accordance with one or more embodiments of the present invention. Therein, fins 60*a*-60*f* are substantially constructed as taught with respect with fin 10. However, fins 60*a*, 60*c*, 60*e*, and 60*f* comprise one or more additional fluid flow edges 22*e*-22*f* that help direct the fluid flow on the top surface. Fins 60*b*-60*f* may also include one or more shaped edges 23 that help in directing fluid flow.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention. Furthermore, the foregoing describes the invention in terms of embodiments foreseen by the inventor for which an enabling description was available, notwithstanding that insubstantial modifications of the invention, not presently foreseen, may nonetheless represent equivalents thereto.

What is claimed is:

1. A swim fin comprising:

a foot pocket and a blade portion, the blade portion comprising a top surface and a bottom surface;

an opening through the blade portion, the opening permitting an enhanced directional fluid flow between the top and the bottom surface; and a top bevel disposed in the top surface and surrounding the opening, the top bevel comprising a trailing and a leading top bevel area to compress the fluid flow;

wherein one of the trailing and the leading top bevel area is larger than the other of the trailing and the leading top bevel area.

2. The swim fin of claim 1, wherein the fin promotes a faster down beat.

3. The swim fin of claim 1, further comprising a bottom bevel, the bottom bevel disposed in the bottom surface and having a trailing and a leading bottom bevel area.

4. The swim fin of claim 3, wherein the trailing and the leading bottom bevel areas are substantially equal in size to retard fluid flow through the opening.

5. The swim fin of claim 4, wherein the fin promotes greater propulsion.

6. A swim fin comprising:

a foot pocket and a blade portion, the blade portion comprising a top surface and a bottom surface;

an opening through the blade portion, the opening permitting an enhanced directional fluid flow between the top and the bottom surface;

a top bevel disposed in the top surface and surrounding the opening, the top bevel comprising a trailing and a leading top bevel area to compress the fluid flow;

a bottom bevel, the bottom bevel disposed in the bottom surface and having a trailing and a leading bottom bevel area;

wherein one of the trailing and the leading top bevel area is larger than the other of the trailing and the leading top bevel area; and wherein the trailing and the leading bottom bevel areas are substantially equal in size to retard fluid flow through the opening.

7. The swim fin of claim 6, further comprising a plurality of openings for permitting a fluid flow between the top and the bottom surface, each of the plurality of openings being surrounded by a respective top and bottom bevel.

8. The swim fin of claim 1, wherein the blade portion is disposed in a cover which comprises a convex shape for scooping water via the blade portion.

9. The swim fin of claim 1, wherein the blade portion comprises a front edge that increases from an outside edge of the fin to an inside edge of the fin.

10. The swim fin of claim 9, wherein the front edge has a curvilinear shape.

11. The swim fin of claim 9, wherein inside and outside edges are elongated.

12. The swim fin of claim 1, comprising a cover and a plurality of channelization edges in a top surface of the cover.

13. A swim fin comprising:

a foot bed;

a cover having a substantially convex shape, the cover enclosing a portion of the foot bed to form a foot pocket for a user's foot, the cover comprising a blade portion having a plurality of openings, at least one opening associated with a bevel for providing an enhanced directional fluid flow;

wherein the bevel comprises a trailing top bevel area and a leading top bevel area;

wherein one of the trailing and the leading top bevel area is larger than the other of the trailing and the leading top bevel area.

14. The swim fin of claim 13, wherein the cover maintain a semi-rigid shape.

15. The swim fin of claim 13 further comprising a front edge of the blade portion that has a curvilinear shape.

16. The swim fin of claim 13, wherein a surface area of the blade portion to a surface area of the foot bed comprises 1.1 or greater.

17. The swim fin of claim 13, wherein the swim fin has a length-to-width ratio of 2.0 or less.

18. The swim fin of claim 13, wherein the cover comprises a plurality of channelization edges.

* * * * *